US010197051B2

(12) United States Patent
Anderson

(10) Patent No.: US 10,197,051 B2
(45) Date of Patent: Feb. 5, 2019

(54) PUMP CONTROL SWITCH

(71) Applicant: Merrill Manufacturing Company, Storm Lake, IA (US)

(72) Inventor: Stephen J Anderson, Storm Lake, IA (US)

( * ) Notice: Subject to any disclaimer, the term of this patent is extended or adjusted under 35 U.S.C. 154(b) by 557 days.

(21) Appl. No.: 14/665,826

(22) Filed: Mar. 23, 2015

(65) Prior Publication Data

US 2016/0281703 A1 Sep. 29, 2016

(51) Int. Cl.
*F04B 49/06* (2006.01)
*F04B 23/02* (2006.01)

(52) U.S. Cl.
CPC ..... *F04B 49/06* (2013.01); *F04B 23/02* (2013.01)

(58) Field of Classification Search
CPC ..... F04B 49/06; F04B 23/02
See application file for complete search history.

(56) References Cited

U.S. PATENT DOCUMENTS 4,339,231 A * 7/1982 Conery ..... H02G 3/086 174/560
4,462,758 A * 7/1984 Speed ..... F04B 49/06 200/83 R
4,628,236 A * 12/1986 Schaefer ..... H02P 1/44 174/542
5,565,720 A * 10/1996 Janisse ..... H01H 9/08 310/68 A
6,456,470 B1 * 9/2002 Cecconi ..... H02K 17/30 361/103
2005/0198988 A1 * 9/2005 Cecconi ..... F04B 39/12 62/298

OTHER PUBLICATIONS

Washington State Department of Health "Small Water Systems—Pump controls", Mar. 2008.*

* cited by examiner

*Primary Examiner* — Charles Freay
*Assistant Examiner* — Lilya Pekarskaya

(57) ABSTRACT

A pump control switch for controlling the operation of a pump, where the pump switch includes a pressure activated switch and a run capacitor located in a single housing. The pressure switch is attached by a pipe fitting to be in fluid communication with the water line that feeds into a storage tank, to sense the water system pressure. The water system pressure sensed by the switch moves the electrical contacts in the switch between their open and closed positions. The pressure switch is disposed to operably electrically interconnect a power source, the run capacitor, and the pump motor.

2 Claims, 3 Drawing Sheets

PUMP CONTROL SWITCH

BACKGROUND OF THE INVENTION

Field of the Invention

The present invention relates to the field of pump controls, and more particularly to a pump control switch.

Description of the Related Art

The traditional control box has a terminal strip for the wires incoming from the pressure switch and the outgoing wires to the pump motor. The control box also has a start capacitor that is used only for starting the pump motor, wired inside the box that is part of the control box wiring that helps to start the motor. This requires wiring from the pressure switch run to the control box and then wiring from the control box to the pump.

The traditional system components have always been wired as follows: First, wiring from the power disconnect to the pressure switch, where the pressure switch is connected to the water line that is under the water system pressure from the pump and storage tank by a pipe fitting; second, wiring from the pressure switch to the control box; and third, wiring from the control box to the submersible motor on the pump.

When the pressure switch is connected to the traditional pressure tank, and also connected to a separate control box as is typically done today, troubleshooting is difficult because all the components are separated.

While the aforementioned prior art construction is adequate for the basic purpose and function for which it has been specifically designed, it is uniformly deficient with respect to its failure to provide a simple, efficient, and practical pump control switch that uses a minimum number of components positioned at a single location.

As a consequence of the foregoing situation, there has existed a longstanding need for a new and improved pump control switch and the provision of such a construction is a stated objective of the present invention.

BRIEF SUMMARY OF THE INVENTION

Briefly stated, the present invention provides a pump control switch for controlling the operation of a pump, where the pump switch includes a pressure activated switch and a run capacitor located in a single housing. The pressure switch is attached by a pipe fitting to be in fluid communication with the water line that feeds into a storage tank, to sense the water system pressure. The water system pressure sensed by the switch moves the electrical contacts in the switch between their open and closed positions. The pressure switch is disposed to operably electrically interconnect a power source, the run capacitor, and the pump motor.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with drawings, wherein.

DETAILED DESCRIPTION OF THE INVENTION

Figure 1:
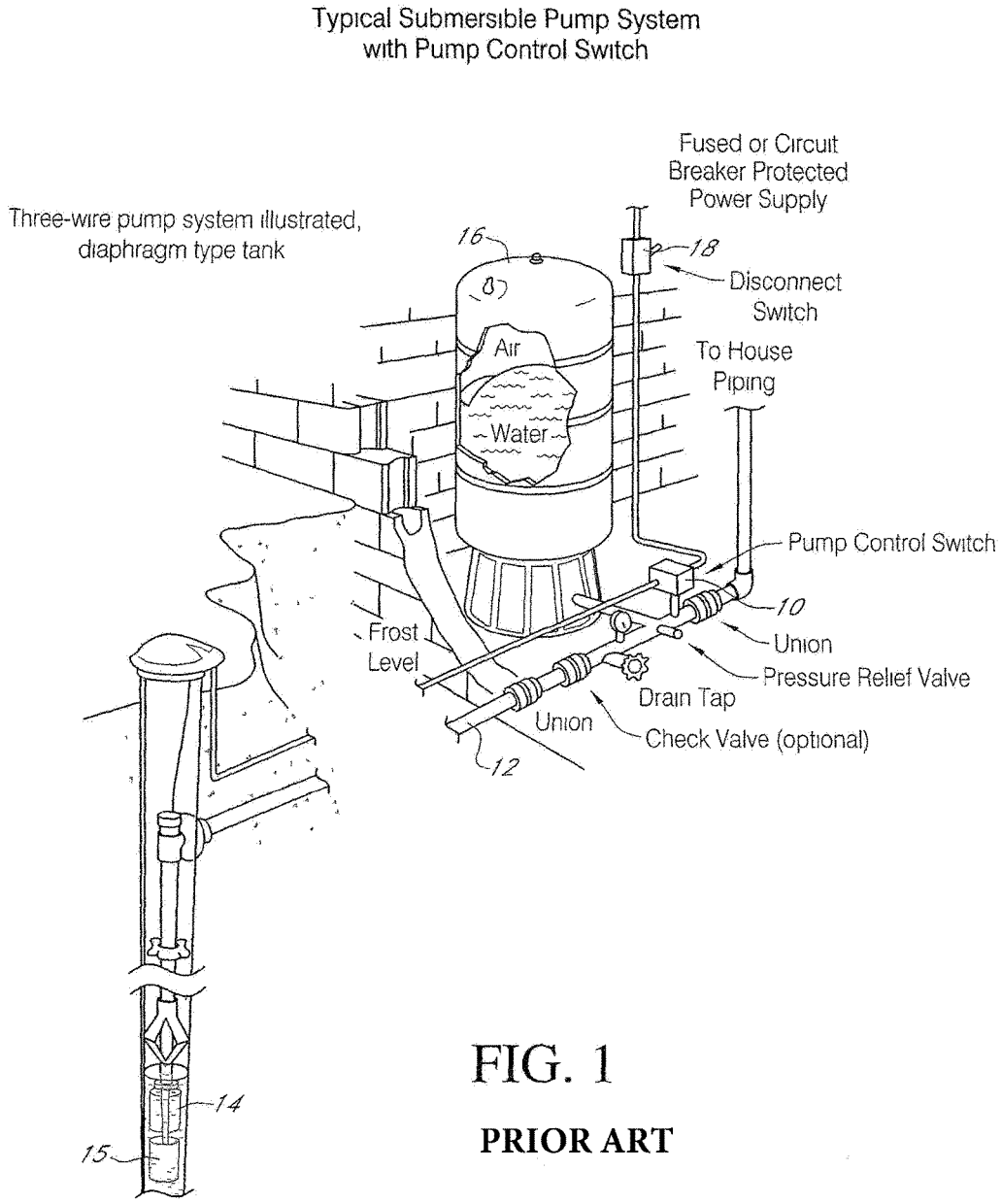
FIG. 1 PRIOR ART
FIG. 1 is a schematic view showing the pump control switch of the present invention used in a typical submersible pump system.

As can be seen by reference to the drawings, and particularly to FIG. 1, a pump control switch that forms the basis for the present invention is designated generally by the reference numeral (10).

Figure 2:
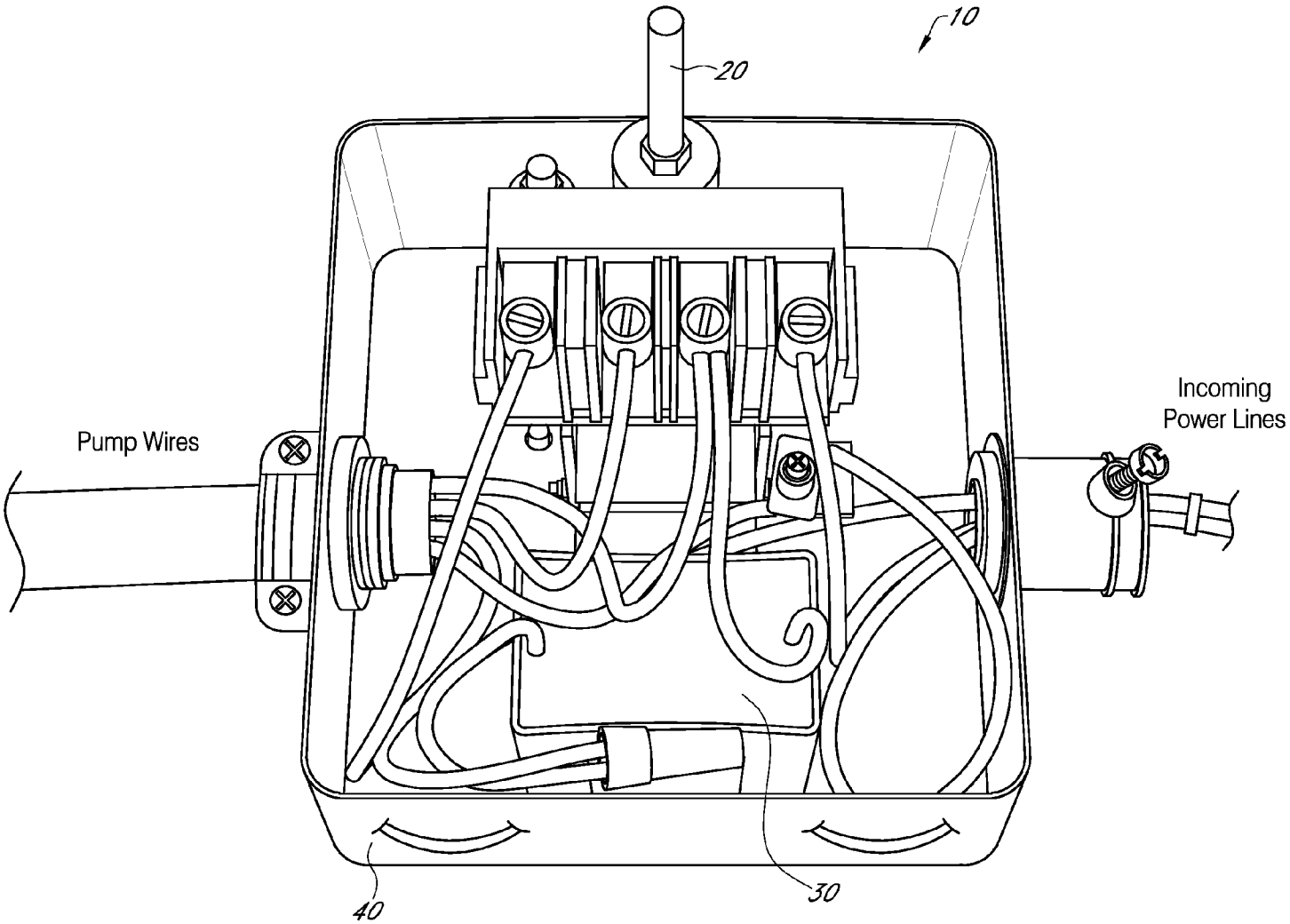
FIG. 2 is a perspective view illustrating the pressure switch and run capacitor located in a single housing, together with the electrical connections coming from the power source and going to the pump.
Figure 3:
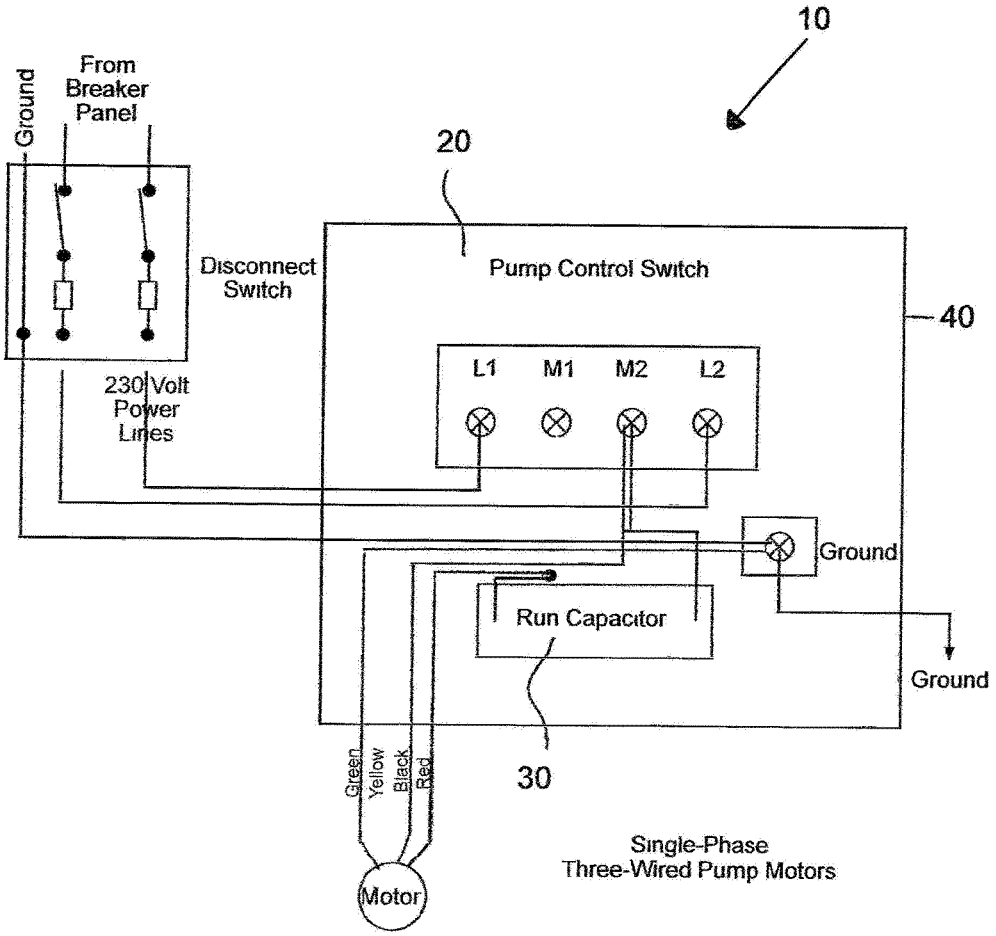
FIG. 3 is a wiring diagram for the pump control switch of the present invention.

The present invention involves the combination of functions of the old pump control box and pressure switch. This combination has not been made before, and the new pump control switch eliminates the old control box for ½ through 1½ HP-3 wire submersible pumps. As illustrated in FIGS. 2 and 3, the new pump control switch (10) includes a pressure switch (20) and a custom made run capacitor (30) located in a single housing (40).

FIG. 1 shows the pump control switch (10) attached to and in fluid communication with a water line (12) which is fed by a submersible pump (14) and a water storage tank (16). The pump control switch (10) is also electrically connected to a power source (18) and to the pump motor (15).

The pressure switch (20) senses the water system pressure to move the electrical contacts in the switch (20) between an open and a closed position. This controls the flow of electrical power to the run capacitor (30) and the pump motor (15).

The pressure switch (20) and the run capacitor (30) are both enclosed in a single housing (40). This results in several advantages over the prior art, in which the pressure switch and the start capacitor are located in two separate housings positioned at separate locations.

FIGS. 1-3 show how and why the pump control switch (10) is simpler to install. Also, with all the pump control components together in the same housing, it is simpler to test and trouble shoot.

The pump control switch (10) lowers the cost of the installation when compared to the cost of installing the traditional pressure switch and control box in two separate housings at two separate locations.

The pump control switch of the present invention is contained in a single housing. This pump control switch: eliminates the extra cost for a control box with terminal strip and start capacitor; eliminates extra wiring and labor which reduces the cost for installation; and makes trouble shooting easier since all components are located in one place. Also, the run capacitor used in the present invention is always working and this reduces the electrical running load of the pump. Applicant estimates that the reduction in material and labor costs will be in the range of 30 to 40 percent, and the reduction in power cost to be about 10 to 20 percent.

The control switch of the present invention has all the features of a conventional heavy duty pressure switch plus a run capacitor that is always on, rather than the start capacitor that is for starting the motor only. This invention combines the two main pump control components into one heavy duty pump control switch.

Although only an exemplary embodiment of the invention has been described in detail above, those skilled in the art will readily appreciate that many modifications are possible without materially departing from the novel teachings and advantages of this invention. Accordingly all such modifications are intended to be included within the scope of this invention as defined in the following claims.

The invention claimed is:

1. A pump control switch consisting of:

a pressure activated switch disposed in fluid communication with a water line, and being operably electrically connected to a power source and to a pump motor;

a single run capacitor being operably electrically connected to the power source and to the pump motor, wherein the single run capacitor is always on when the pump motor is running and handles the full amperage load of the pump motor all the time the pump motor runs, and thereby lowers pump motor running amperage; and a single closed housing wherein both the pressure activated switch and the single run capacitor are contained within the single closed housing.

2. The control switch of claim 1, wherein the water line is disposed in fluid communication with a water storage tank.

* * * * *